US005831498A

United States Patent [19]

Maloney et al.

[11] Patent Number: 5,831,498

[45] Date of Patent: Nov. 3, 1998

[54] MOLDED CASE CIRCUIT BREAKER WITH ADAPTER FOR USE WITH RING LUG TERMINATIONS

[75] Inventors: James G. Maloney, Industry; Michael J. Whipple, New Sewickley Township, both of Pa.

[73] Assignee: Eaton Corporation, Cleveland, Ohio

[21] Appl. No.: 846,397

[22] Filed: Apr. 30, 1997

[51] Int. Cl.[6] ..... H01H 75/00

[52] U.S. Cl. ..... 335/8; 335/202

[58] Field of Search ..... 335/6, 8–10, 132, 335/202; 200/293–305; 361/363, 353–55, 360–1, 373, 376, 427

[56] References Cited

U.S. PATENT DOCUMENTS

| | | | |
|---|---|---|---|
| 3,999,103 | 12/1976 | Misencik et al. . | |
| 4,609,898 | 9/1986 | Seymour et al. | 200/293 |
| 4,965,544 | 10/1990 | Kelaita et al. | 200/305 |
| 5,150,091 | 9/1992 | Hart et al. | 335/202 |
| 5,446,431 | 8/1995 | Leach et al. | 335/202 |
| 5,453,723 | 9/1995 | Fello et al. . | |
| 5,488,337 | 1/1996 | Hubbard et al. | 335/132 |

*Primary Examiner*—Lincoln Donovan
*Attorney, Agent, or Firm*—Martin J. Moran

[57] ABSTRACT

A miniature molded case circuit breaker is adapted for use with load conductors having ring lug terminations by extending the circuit breaker load terminal conductor through the terminal recess and beyond the molded housing. An adapter includes an insulative shield member having an open slot in which the load terminal conductor terminates for connection to the ring lug on a load conductor. The adapter further includes an insulator which seats snugly in the terminal recess of the housing and through which the load terminal conductor extends. A bifurcated neck on the insulator extends through an opening into the shield member. The shield member is secured to the circuit breaker by projections which snap into grooves in the neck portion of the insulator and a cantilevered resilient finger which engages a catch on the molded housing.

8 Claims, 5 Drawing Sheets

FIG. 1
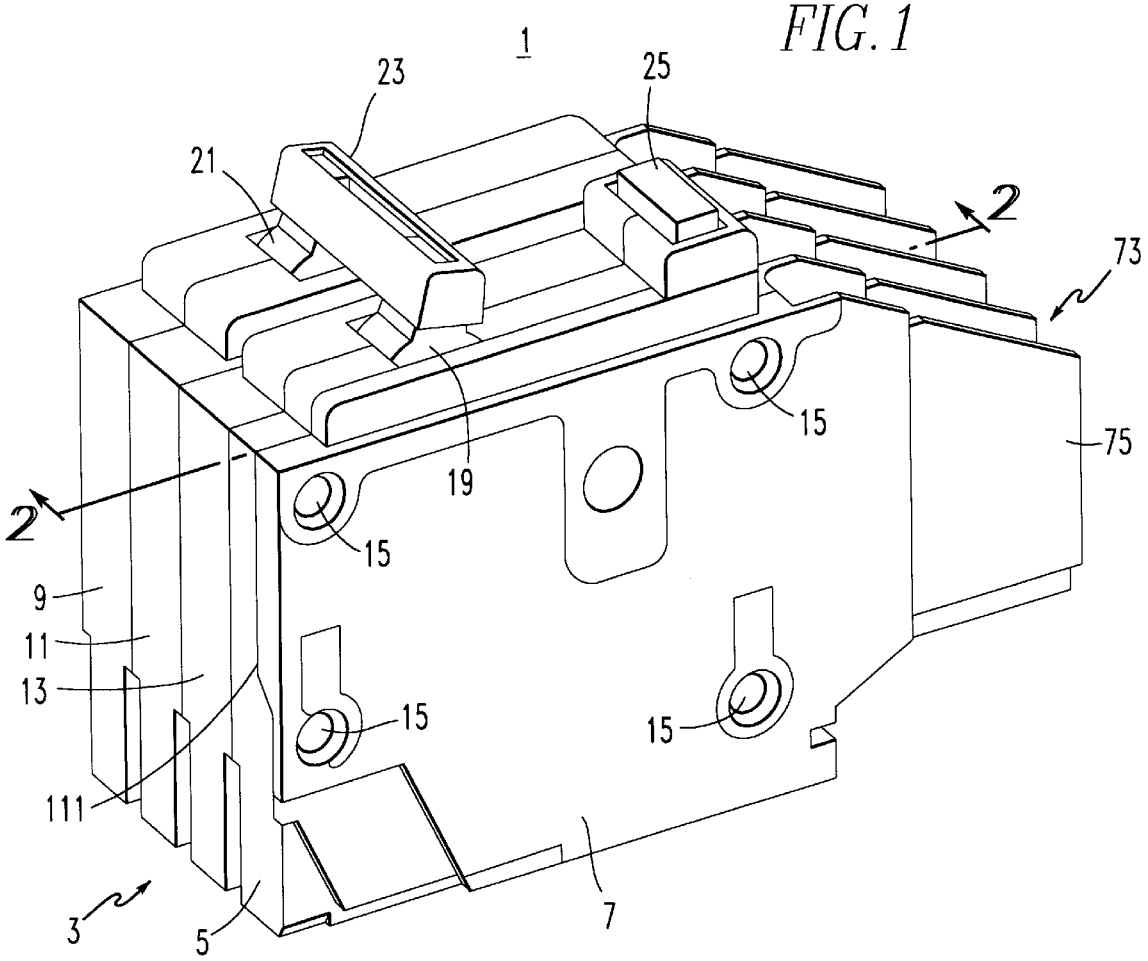
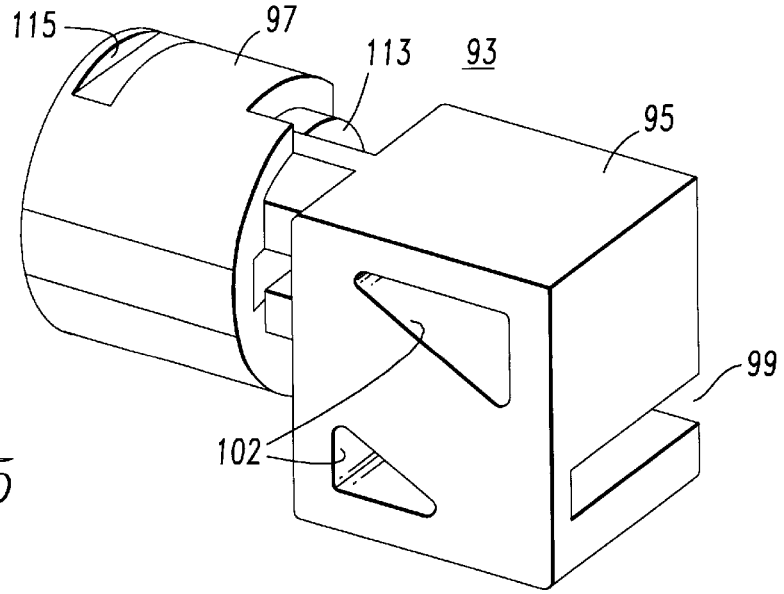
FIG. 5

73
75
17
77
137
67
69
97
65
123
125
61
127
115
121
93
119
129
115
113
63
57
95
55
47
55
59
49
45
51
31
43
19
41
39
33
5
35
29
43
37

FIG.3
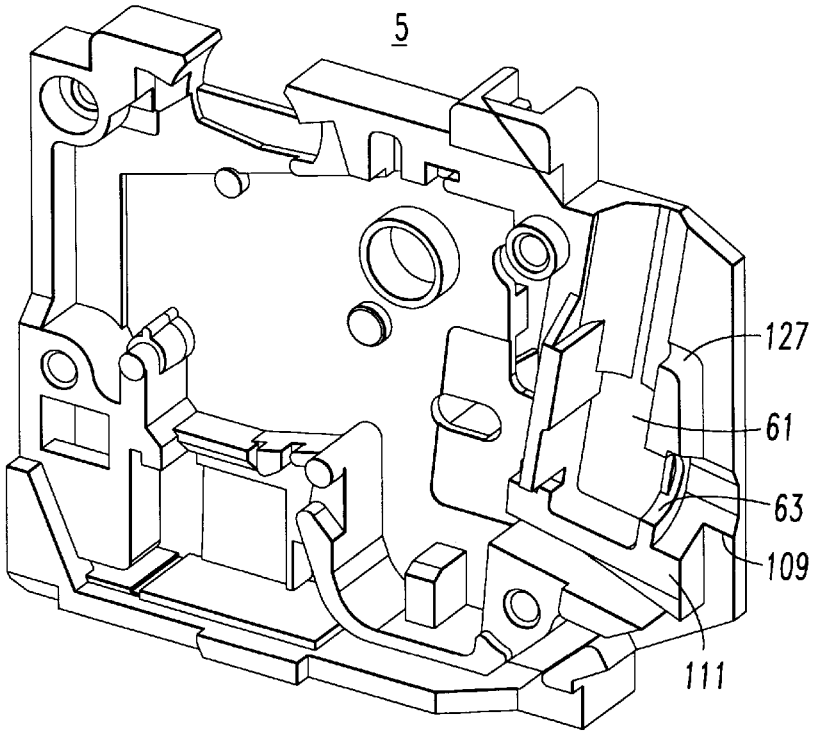
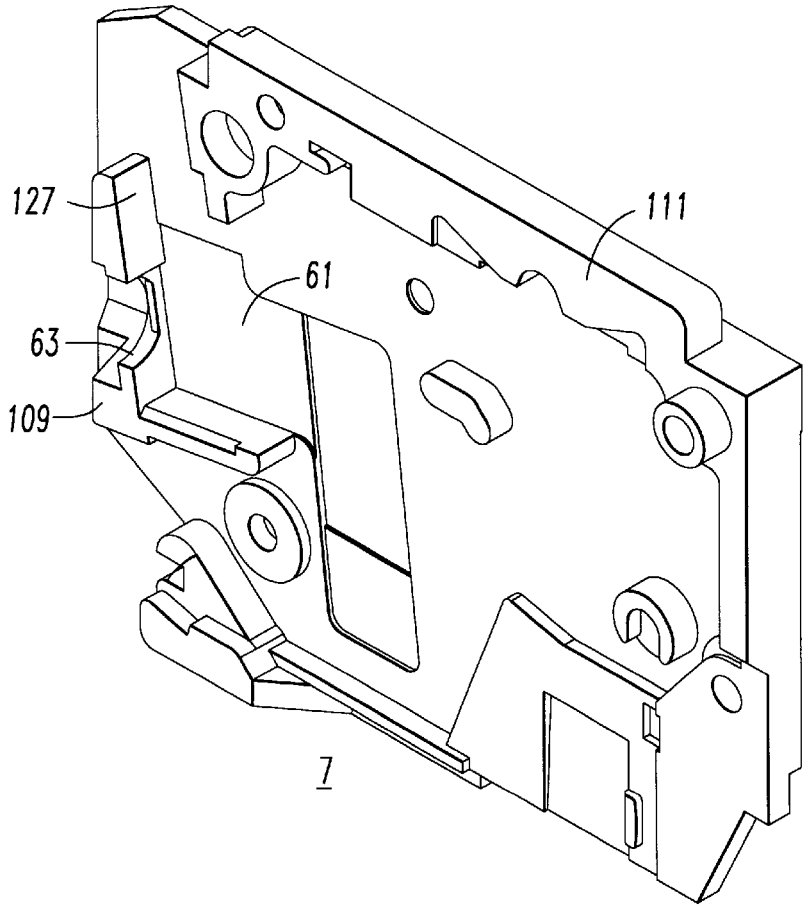
FIG.4

MOLDED CASE CIRCUIT BREAKER WITH ADAPTER FOR USE WITH RING LUG TERMINATIONS

BACKGROUND OF THE INVENTION

1. Field of the Invention

This invention relates to miniature molded case circuit breakers, and particularly to an adapter for permitting use of the circuit breaker with electrical conductors having ring lug terminations without requiring reconfiguration of the molded housing of the circuit breaker.

2. Background Information

The typical circuit breakers used in residences and light commercial applications are commonly referred to as "miniature molded case circuit breakers." Such circuit breakers have a housing molded in two or more sections from an electrically insulative resin. The dimensions of the housings are standardized for interchangeable use in load centers. One pole circuit breakers of this type are typically three quarters to an inch thick. Two pole circuit breakers of this type have side-by-side compartments for the poles making them proportionally thicker, but still relatively thin. For applications where ground fault protection is desired, the ground fault circuitry is housed in one compartment and the mechanical pole in an adjacent compartment. A load terminal is provided in such a miniature molded case circuit breaker by a rigid conductor which extends from the separable contacts within the housing to a terminal recess molded in the outer surface of the housing. Typically, a screw clamp secures the stripped end of a load conductor inserted through an aperture in the wall of the terminal recess to the terminal end of the rigid conductor. Commonly the housing is molded in sections which are joined together along parting lines which extend through the terminal recesses and the apertures through which the load conductors are inserted. The terminal recesses for multi-pole circuit breakers are located side-by-side.

There is a growing interest in using such miniature molded case circuit breakers with load conductors having ring lug terminations. Such terminations comprise a flat ring defining an aperture through which a screw is passed to clamp the ring to the rigid conductor in the circuit breaker. The end of the load conductor is crimped in a cylindrical extension formed integrally with the ring. The ring lugs required for the typical current ratings of such circuit breakers makes them too large to be used with the existing molded case circuit breakers. While the molded housings could be modified to accept ring lug terminations, it is expensive to make such modifications and to have to have separate housings for different types of terminations. Any arrangements to accommodate for the ring lug terminations must maintain electrical clearances and satisfy temperature restrictions.

There is a need therefor for improved miniature molded case circuit breakers which can accommodate ring lug terminations.

There is a further need for such an improved miniature molded case circuit breaker which can accommodate ring lug terminations without requiring modifications to the molded housing of the circuit breaker.

There is also a need for such an improved miniature molded case circuit breaker which can still be used with other types of terminations such as screw clamps.

There is still another need for such an improved miniature circuit breaker which meets electrical clearances, temperature limitations, and size requirements.

SUMMARY OF THE INVENTION

These needs and others are satisfied by the invention which is directed to a miniature molded case circuit breaker adapted to be used with ring lug terminations, and an adapter which provides such capability without requiring modification to the molded housing of the circuit breaker. In accordance with the invention, the rigid conductor connected to the separable contacts within the molded housing extends through the terminal recess and beyond the outer surface of the molded housing. An adapter which includes an electrically insulated shield member forms an open slot into which the rigid conductor extends for connection to the ring lug termination. Connector means secure the shield member to the molded housing.

In its preferred form, the adapter further includes an insulator having a passage through which the rigid conductor extends. This insulator is dimensioned to be snugly seated in the terminal recess of the molded housing. Where the molded housing is formed from sections joined along a parting line extending through the terminal recess, the insulator has a neck portion extending through an aperture in the housing formed at the parting line. This neck portion is configured to be engaged in the aperture to firmly support the insulator.

Most preferably, the insulator has a longitudinally extending open slot forming the passage through which the load conductor extends. This open slot longitudinally bifurcates the neck portion to form a pair of laterally cantilevered spaced apart arms. These spaced apart arms extend through an opening in the shield member. In this configuration, the connector means includes a groove in at least one of the arms on the neck portion of the insulator and at least one corresponding projection on the shield member which compresses the arms as the neck portion in the insulator enters the shield member and then snaps into engagement with the groove. Preferably, such grooves are provided on both of the cantilevered arms and there are two projections in the shield member which squeeze the arms together and then snap into the grooves to lock the shield member to the molded housing.

The connector means securing the shield member to the molded housing also includes snap lock means in the form of a resilient finger on the shield having a hook on the free end which engages a molded catch on the housing.

BRIEF DESCRIPTION OF THE DRAWINGS

A full understanding of the invention can be gained from the following description of the preferred embodiments when read in conjunction with the accompanying drawings in which:

FIG. 1 is an isometric view of a two pole, ground fault miniature circuit breaker incorporating the invention.

FIG. 3 is an isometric view of a molded section of the circuit breaker of FIG. 1 and which is shown in FIG. 2.

FIG. 4 is an isometric view of the inside of the molded cover of the circuit breaker which was removed in FIG. 2.

FIG. 5 is an isometric view of an insulator which forms part of the invention.

DESCRIPTION OF THE PREFERRED EMBODIMENT

Figure 2:
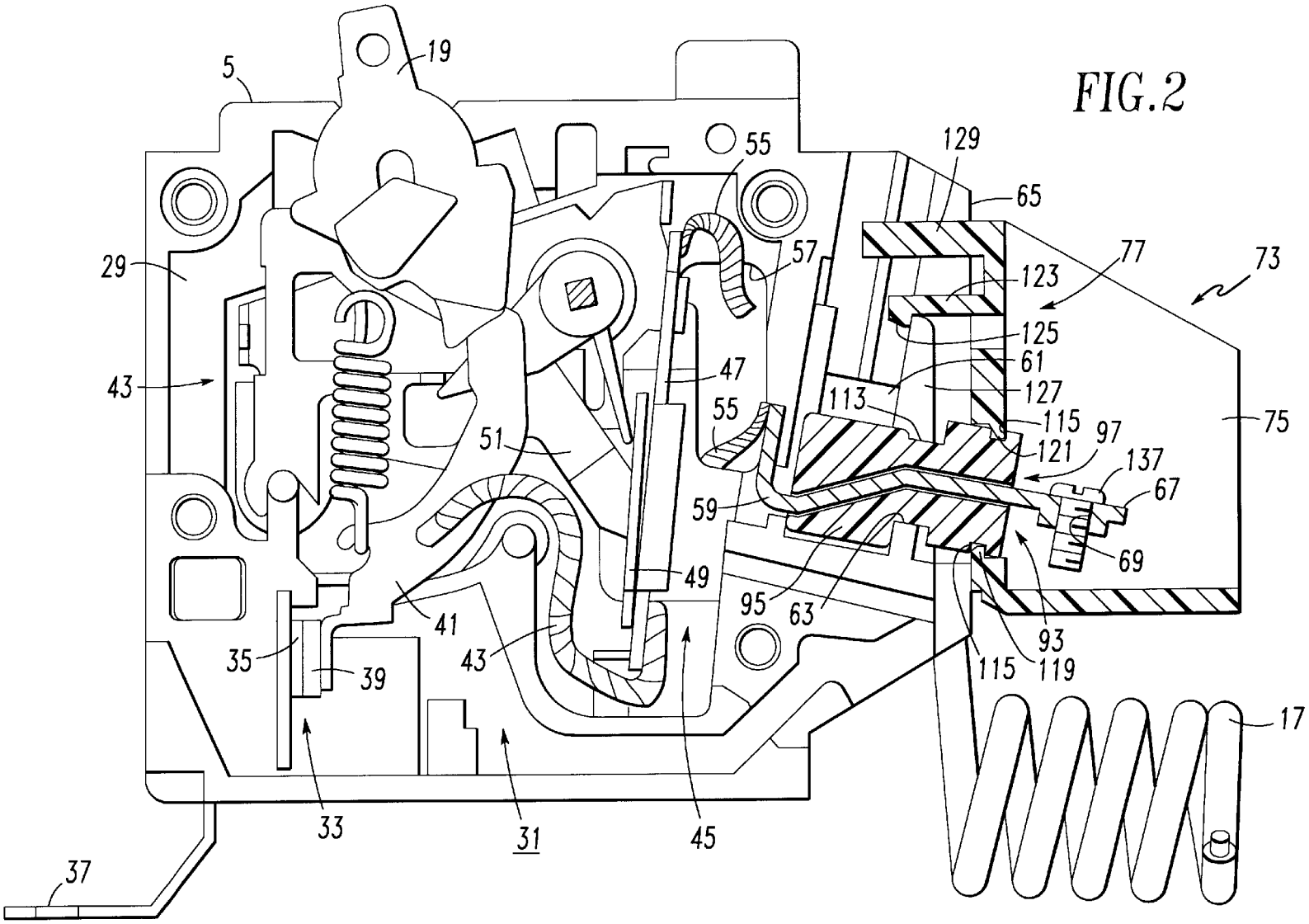
FIG. 2 is a side view of a circuit breaker of FIG. 1 with the cover removed and showing the ring or adapter in accordance with the invention in section.

FIG. 1 illustrates application of the invention to a two pole, ground fault, miniature circuit breaker 1 such as that shown in U.S. Pat. No. 5,453,723, which is hereby incorporated by reference. The circuit breaker 1 has a housing 3 which is molded in sections from an electrically insulating material such as a thermal setting resin. The sections of the housing 3 include a top base 5, a top cover 7, a bottom cover 9, a bottom base 11 and a hollow center base 13, all secured together such as by rivets 15. As can be seen in FIG. 2, a pigtail 17 connects a neutral conductor within the circuit breaker to a neutral bar (not shown) in a load center in which the circuit breaker 1 may be mounted. Each of the poles of the circuit breaker has an operating handle 19 and 21 which may be operated in unison by the handle tie 23. In addition, the operation of the ground fault circuit of the circuit breaker 1 can be tested by depressing the test button 25.

The molded sections 5, 7, 9, 11 and 13 form internal compartments in the housing 3. As shown in FIG. 2 in which the top cover 7 has been removed, the top base 5 and top cover 7 form a compartment 29 for one pole 31 of the circuit breaker 1. The bottom cover 9 and bottom base 11 form a similar compartment (not shown) for the other pole. The top base 5, bottom base 11 and the hollow center base 13 together form a center compartment (not shown) for the ground fault circuitry (also not shown). Details of this compartmentalization are shown in U.S. Pat. No. 5,453,723. As shown in FIG. 2, the pole 31 includes separable contacts 33 comprising a fixed contact 35 connected to a line terminal 37 and a moveable contact 39 mounted on the end of a curved contact arm 41 which forms part of an operating mechanism 43. The operating mechanism 43 moves the separable contacts 33 between the closed position shown in FIG. 2 and an open position in which the fixed contact 35 and moveable contact 39 are separated to interrupt current. The operating mechanism 43 can be operated manually through the handle 19 or automatically by a thermal-magnetic trip mechanism 45. The trip mechanism 45 includes a bimetal 47 and a magnetic armature 49 which latches a cradle 51 of the operating mechanism 43. With the separable contacts 33 closed, as shown in FIG. 2, current passes from the line terminal 37 through the separable contacts 33, the contact arm 41, and a flexible shunt 43 to the free lower end of the bimetal 47 which is fixed at its upper end. The current then passes through the bimetal 47 and through another flexible conductor 55 which passes through an opening 57 in top base 5 to the center compartment (not shown) where it passes through ground fault circuitry (not shown). This flexible conductor 55 then comes back through the opening 57 and is connected to a rigid load terminal conductor 59. The operation of the operating mechanism 43 and thermal-magnetic trip mechanism 45 are well known and are described in U.S. Pat. No. 5,453,723 and, for instance, in U.S. Pat. No. 3,999,103.

In a typical prior art circuit breaker, the rigid load terminal conductor 59 extends into a load terminal recess 61 molded into the top base 5 and top cover 7 of the housing 3 where it is secured to a load conductor inserted through an aperture 63 such as by a screw connector (not shown).

As mentioned, there is growing interest in being able to secure the load conductor with a ring lug terminal. However, the size of the terminal recess 61 and aperture 63 do not accommodate such a termination. While the housing sections 5 and 7 could be modified to accommodate such a termination, this requires different housings for the two different types of terminations.

In accordance with the invention, minimal modification is required to the circuit breaker and, of significance, no modification to the molded sections of the housing is needed. Instead, the rigid load terminal conductor 59 is extended to pass through the terminal recess 61, the aperture 63, and beyond the terminal surface 65 of the molded housing where it terminates in a terminal end 67 adapted by an aperture 69 which is swaged and tapped for connection to a ring lug termination 71 (see FIG. 8). In order to electrically shield the rigid load terminal conductor 59 which extends beyond the housing 3 of the circuit breaker, the invention includes an adapter 73. This adapter 73 includes a shield member 75 and a connector arrangement 77 for connecting the shield member to the circuit breaker housing 3.

Figure 7:
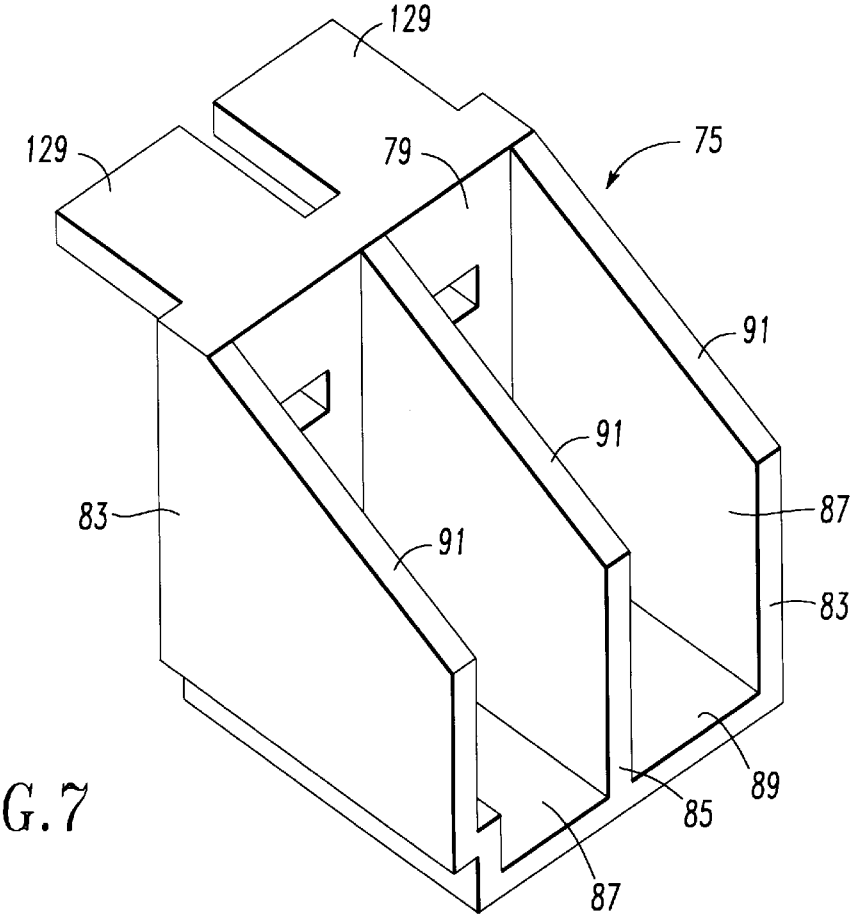
FIG. 7 is an isometric view of the adapter which forms part of the invention.
Figure 8:
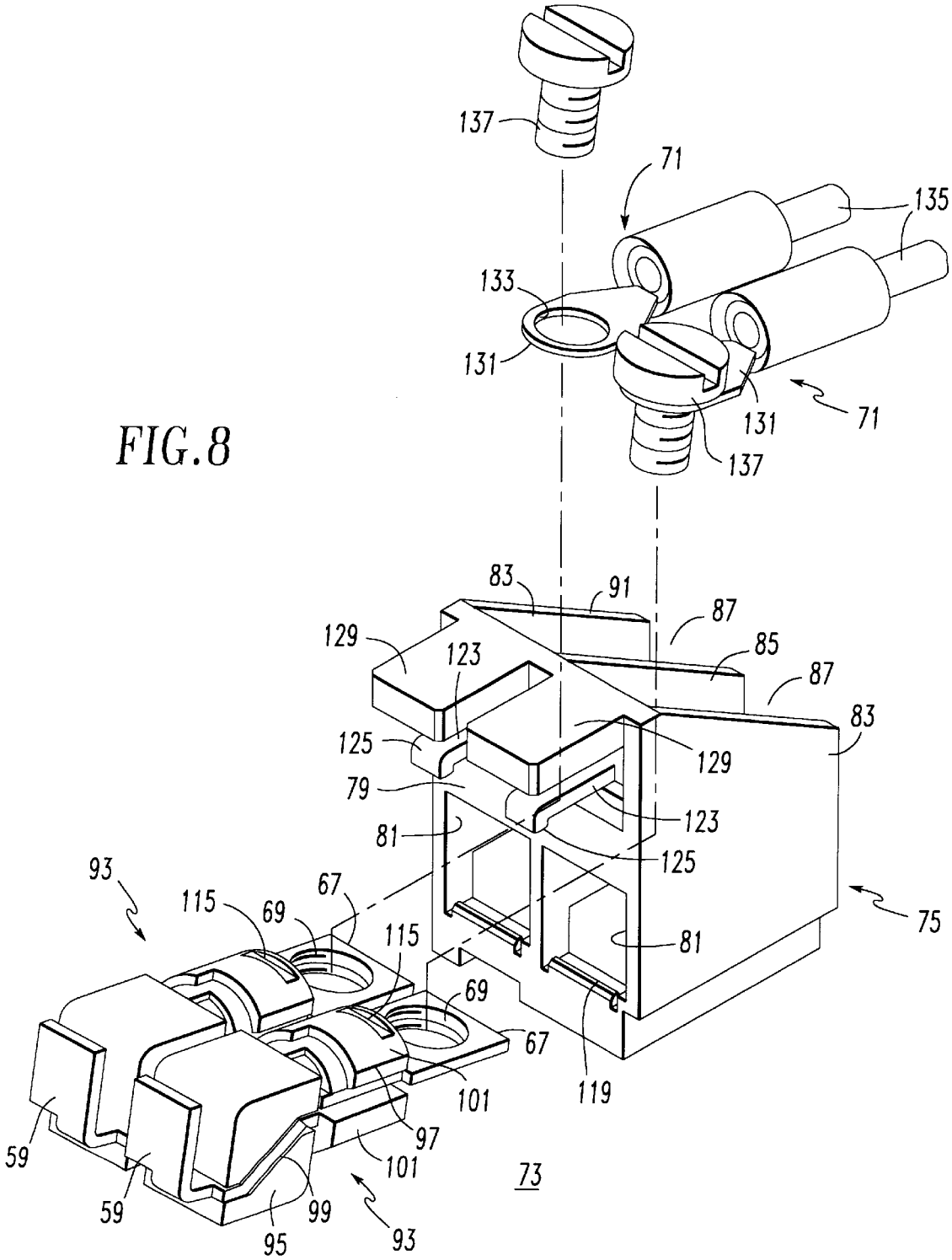
FIG. 8 is an exploded isometric view of an assembly of the insulator adapter and conductor of FIGS. 5–7 and a pair of terminal lugs.

The shield member 75, in the preferred form of the invention, spans two of the terminal recesses 61 on the circuit breaker housing. It should be recalled that the particular circuit breaker 1 illustrated is a two pole ground fault circuit breaker. Such a circuit breaker is twice the width of a standard one pole circuit breaker which has two terminal recesses. Thus, the adapter 73 is diminsioned for use with a single pole circuit breaker, with two such standard adapters 73 being used with the two pole ground fault circuit breaker shown (see FIG. 1). Referring to FIGS. 2, 7, and 8, shield member 75 has an end wall 79 which abuts the terminal surface 65 of the circuit breaker and has openings 81 aligned with the apertures 63. The shield member 75 further has side walls 83 and a center wall 85 extending outwardly from the end wall 79 to form open slots 87 which are closed at the bottom by a bottom wall 89. The top edges of the side walls 83 and center wall 85 are cut on a bias as at 91.

Figure 6:
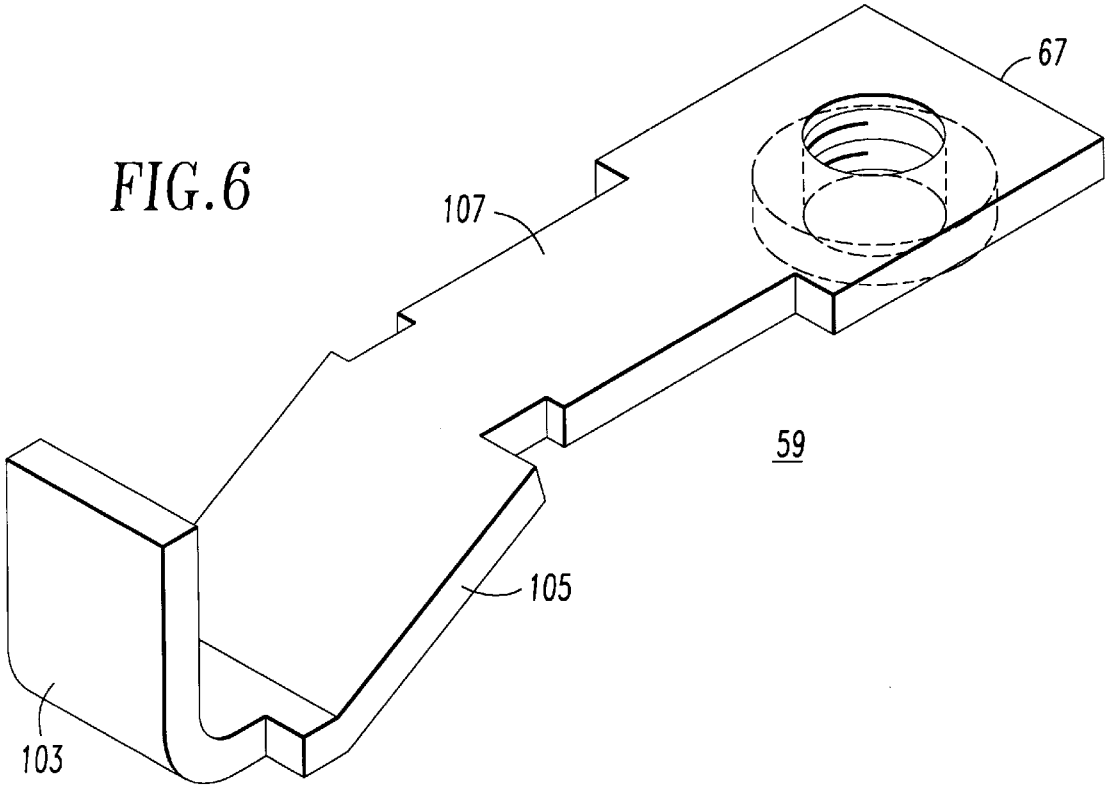
FIG. 6 is an isometric view of a pole conductor of the circuit breaker in accordance with the invention.

The adapter 73 further includes a molded insulator 93 which is best seen in FIGS. 5 and 8. This insulator 93 has a cube-shaped base 95 and a generally cylindrical neck portion 97 extending from a side of the base 95. The insulator 93 has a longitudinally extending passage in the form of a slot 99 which extends diagonally through the base 95 and bifurcates the neck portion 97 into two, spaced apart, cantilevered arms 101. Blind recesses 102 in the base 95 reduce the mass of the insulator 93 (see FIG. 5). The rigid conductor 59, as best seen in FIG. 6, has an inner end section 103 to which the flexible conductor 55 is brazed, a diagonal section 105 which is received in the diagonal section of the slot 99 and a straight section 107 which extends through the neck 97 of the insulator. The insulator 93 electrically isolates the rigid conductor 59, but also forms part of the connector arrangement 77.

As can be seen from FIGS. 3 and 4, the molded sections 5 and 7 of the housing have an internal structure which supports the separable contacts 33, operating mechanism 43, and trip mechanism 45. The molded sections 5 and 7 also have confronting projections 109 which mate along a parting line 111 (see FIG. 1 also) to form the terminal recess 61 and aperture 63. The base 95 of the insulator 93 is sized to be received snugly in the terminal recess 61. The neck 97 of the insulator 93 has an annular groove 113 which fits snugly within the aperture 63. The bifurcated neck 97 extends into the aligned opening 81 in the end wall 79 of the shield member 75. A pair of lateral grooves 115 are provided in the upper and lower arms 101 of the neck 97. As best seen in FIG. 8, a lip 119 projects upward from the outer edge of the bottom of opening 81, while a second lip 121 projects downwardly from the inner surface of the top of the opening 81 as best seen in FIG. 2.

The shield member 75 is secured to the circuit breaker 1 by pushing it on over the end of the neck 97 on the insulator 93 so that the terminal end 67 of the rigid conductor 59 extends into the open slot 87. As the shield member 75 is pushed onto the insulator 93, the arms 101 compress until the lips 119 and 121 drop into the lateral grooves 115 and the arms spring outward to securely engage the lips 119 and 121.

The connector arrangement 77 also includes a pair of cantilevered fingers 123 projecting outward from the end wall 79 of the shield member 75. Hooks 125 on the ends of these fingers 123 snap over and engage a catch 127 formed by the upper ends of the projections 109 in the molded sections 5 and 7 of the housing 3. Molded extensions 129 above the cantilevered fingers 123 block off the top of the terminal recesses 61 and prevent exposure of the locking fingers 123.

The ring lug terminations 71 is best seen in FIG. 8. Such a termination includes a flat member 131 with a rounded end having a circular aperture 133 therethrough. The other end of the flat member 131 has a cylindrical section 135 which is crimped on the stripped end of a load conductor 135. The ring lug termination 71 is secured to the terminal end 67 of the rigid conductor 59 by a terminal screw 137 which passes through the hole 133 and is threaded into the tapped hole 69.

The adapter of the invention provides an inexpensive, easily installed arrangement for adapting miniature circuit breakers for use with ring lug terminations. This is accomplished without requiring modification to the moldings of the circuit breaker. In fact, the only adjustment to the circuit breaker is substitution of an elongated load terminal conductor. The arrangement maintains the required electrical separation and satisfies the temperature limitations of these circuit breakers. The adapter is firmly secured to the circuit breaker without the use of any tools.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A miniature molded case circuit breaker adapted for use with conductors having ring lug terminations, said circuit breaker comprising:

a molded housing having a terminal recess in an external surface thereof;

separable contacts mounted in said molded housing;

an operating mechanism within said molded housing for opening and closing said separable contacts;

a load terminal conductor connected to said separable contacts and extending through said terminal recess and beyond said terminal surface of said molded housing where it terminates in a terminal end adapted for securing said ring lug termination thereto;

an adapter comprising an electrically insulative shield member forming an open slot into which said load terminal conductor terminal end extends for connection to said ring lug termination;

connector means connecting said shield member to said molded housing;

wherein said molded case circuit breaker has two terminal recesses in said molded housing and a load terminal conductor extending through at least one terminal recess and having a terminal end extending beyond the terminal recess, and wherein said adapter comprises a shield member forming an open electrically isolated slot associated with each terminal recess and into at least one of which the terminal end of the at least one load terminal conductor extends for connection to said ring lug on an associated conductor; and wherein said adapter further comprises for each terminal recess an insulator having a passage through at least one of which the at least one load terminal conductor extends, said insulator being dimensioned to be snugly seated in the associated terminal recess.

2. The circuit breaker of claim 1 wherein said molded housing is formed from multiple sections joined along parting lines extending through said terminal recesses, with adjacent parts forming apertures at their parting line through which the at least one load terminal conductor extends, each said insulator having a neck portion extending through the associated aperture and configured to be engaged by said associated aperture.

3. The circuit breaker of claim 2 wherein said insulators have neck portions which extend into the corresponding open slot in said shield member, and wherein said connector means comprises cooperating members on said neck portions of said insulators and in the corresponding open slots of said shield member.

4. The circuit breaker of claim 3 wherein said connector means further include at least one cantilevered resilient finger on said shield member aligned with a corresponding terminal recess on said molded housing and having a hook on a free end thereof, and a catch in the corresponding terminal recess in said molded housing over which said resilient finger snaps for engagement by said hook.

5. A miniature molded case circuit breaker adapted for use with conductors having ring lug terminations, said circuit breaker comprising:

a molded housing having a terminal recess in an external surface thereof;

separable contacts mounted in said molded housing;

an operating mechanism within said molded housing for opening and closing said separable contacts;

a load terminal conductor connected to said separable contacts and extending through said terminal recess and beyond said terminal surface of said molded housing where it terminates in a terminal end adapted for securing said ring lug termination thereto;

an adapter comprising an electrically insulative shield member forming an open slot into which said load terminal conductor terminal end extends for connection to said ring lug termination;

connector means connecting said shield member to said molded housing;

wherein said adapter further comprises an insulator having a passage through which said load terminal conductor extends, said insulator being dimensioned to be snugly seated in said terminal recess of said molded housing;

wherein said molded housing is formed from at least two sections joined along a parting line extending through said terminal recess, said at least two sections forming an aperture at said parting line through which said load terminal conductor extends, said insulator having a neck portion extending through said aperture and configured to be engaged in said aperture; and wherein said insulator has a longitudinally extending open slot forming said passage through which said load terminal conductor extends, said open slot longitudinally bifurcating said neck portion to form a pair of laterally cantilevered spaced apart arms, said shield member has an opening through which said spaced apart arms extend and said connector means includes a groove in at least one of said arms on said neck portion of said insulator and at least one corresponding projection on said shield member which compresses said arms as said neck portion of the insulator enters said shield member and then snaps into engagement with said at least one groove.

6. The circuit breaker of claim 5 wherein said connector means further includes at least one cantilevered resilient finger on said shield member having a book on the free end thereof, and a cooperating catch on said molded housing over which said resilient finger snaps for engagement by said hook.

7. An adapter for adapting a molded case circuit breaker having a molded housing made of molded sections joined along a parting line extending through a terminal recess in an external surface thereof, and a load terminal conductor extending through said terminal recess and through an aperture formed at the parting line to a point beyond said molded housing for connection to a conductor having a ring lug termination, said adapter comprising:

an electrically insulative shield member forming an open slot into which said load terminal conductor extends for connection to said ring lug;

an insulator having a passage through which said load terminal conductor extends said insulator being dimensioned to be snugly seated in said terminal recess and having a neck portion extending through said aperture and configured to be engaged in said aperture;

connector means securing said shield member to said molded housing; and wherein said insulator has a longitudinally extending slot forming said passage through which said load terminal conductor extends, said slot longitudinally bifurcating said neck portion to form a pair of laterally cantilevered spaced apart arms, said shield member has an opening through which said spaced apart arms extend and said connector means includes a groove in at least one of said arms on said neck portion of said insulator and at least one corresponding projection on said shield member which compresses said arms as said neck portion of the insulator enters said opening in said shield member and then snaps into engagement with said at least one groove.

8. The adapter of claim 7 wherein said connector means further includes a cantilevered resilient finger on said shield member having a hook on a free end thereof which engages a catch on said molded housing.

* * * * *